US005361680A

United States Patent [19]

Matsui

[11] Patent Number: 5,361,680

[45] Date of Patent: Nov. 8, 1994

[54] PRESSURE-INTENSIFYING TYPE FLUID PRESSURE CYLINDER

[76] Inventor: Akio Matsui, 5, Nagara Ida, Gifu-shi, Gifu-ken, Japan

[21] Appl. No.: 191,279

[22] Filed: Feb. 3, 1994

Related U.S. Application Data

[63] Continuation of Ser. No. 980,752, Nov. 24, 1992, abandoned.

[30] Foreign Application Priority Data

Dec. 13, 1991 [JP] Japan ..... 3-330444
Jul. 20, 1992 [JP] Japan ..... 4-192373

[51] Int. Cl.[5] ..... F15B 11/16; F01B 21/00

[52] U.S. Cl. ..... 91/519; 91/419; 92/29; 92/151

[58] Field of Search ..... 91/41, 42, 44, 43, 45, 91/170 R, 189 R, 511, 512, 519, 520, 534, 535, 536, 419; 92/20, 24, 27, 28, 29

[56] References Cited

U.S. PATENT DOCUMENTS

| | | | |
|---|---|---|---|
| 2,720,190 | 10/1955 | Snyder | 91/519 X |
| 3,050,943 | 8/1962 | Thorel et al. | 91/42 X |
| 3,918,346 | 11/1975 | Ziegler | 91/41 X |
| 3,941,141 | 3/1976 | Robert | 92/24 X |
| 4,325,287 | 4/1982 | Hehl | 91/519 X |
| 4,537,113 | 8/1985 | Stoll et al. | 92/24 |
| 4,577,732 | 3/1986 | Gottling | 92/24 X |
| 5,018,434 | 5/1991 | Haka | 92/29 |
| 5,174,191 | 12/1992 | Leinweber et al. | 91/519 |

FOREIGN PATENT DOCUMENTS

| | | | |
|---|---|---|---|
| 81002 | 7/1920 | Austria | 92/24 |
| 2649958 | 5/1978 | Germany | 92/28 |
| 3429492 | 2/1986 | Germany . | |
| 4032668 | 4/1992 | Germany . | |
| 0802659 | 2/1981 | U.S.S.R. | 92/28 |

OTHER PUBLICATIONS

Abstract of Japanese Patent No. JP-A-58 005 507, published Jan. 12, 1983.

Abstract of Japanese Patent No. JP-A-62 067 309, published Mar. 27, 1987.

*Primary Examiner*—Edward K. Look
*Assistant Examiner*—John Ryznic
*Attorney, Agent, or Firm*—Armstrong, Westerman, Hattori, McLeland & Naughton

[57] ABSTRACT

In a pressure-intensifying type fluid pressure cylinder, an auxiliary cylinder chamber is provided outside a rod cover, a pressure intensifying piston is axially and slidably disposed on the outer peripheral portion of a piston rod in the auxiliary cylinder chamber, and steel balls are disposed around the piston rod in space having a tapered surface in the pressure intensifying piston. Or, a lock concave portion is formed on the outer peripheral portion of the piston rod and a lock member is provided in the pressure intensifying piston which lock member makes the pressure intensifying piston and the piston rod one body by being fixed in the lock concave portion. When the piston rod reaches a little before the end of extrusion, fluid pressure comes through a way in the auxiliary cylinder chamber between the pressure intensifying piston and the rod cover. Here, the pressure intensifying piston moves, the lock member is fixed in the lock concave portion and the pressure intensifying piston is locked with regard to the piston rod, or, the steel balls for lock lock the pressure intensifying piston with regard to the piston rod, application force by the movement of the pressure intensifying piston which receives the fluid pressure is added to application force of the piston rod until the piston rod is extruded to the end position, and application force of the piston rod around the end of extrusion is increased.

10 Claims, 13 Drawing Sheets

PRESSURE-INTENSIFYING TYPE FLUID PRESSURE CYLINDER

This application is a continuation of application Ser. No. 07/980,752 filed Nov. 24, 1992, now abandoned.

BACKGROUND OF THE INVENTION

1. Field of the Invention

The present invention relates to a fluid pressure cylinder, such as, an air cylinder, or an oil hydraulic cylinder, and particularly to a pressure-intensifying type fluid pressure cylinder in which the application of force is intensified around the end of movement of a piston rod.

2. Description of the Prior Art

A fluid pressure cylinder is used in various types of operation mechanisms, such as, a clamp mechanism, a compression mechanism, and a caulking mechanism. In the clamp mechanism, the compression mechanism, and the like, normally, great application force is not necessary at the beginning of the application but great application force is necessary at the end of the application. Accordingly, a fluid pressure cylinder which drives the mechanism should supply greater application force at the end of movement of a piston rod compared with that at the beginning position or at an intermediate position of such piston rods.

Therefore, when the size of (a cylinder tube of) a fluid pressure cylinder for a clamp mechanism, and the like, is designed, a fluid pressure cylinder is normally selected in which cylinder necessary application force at the end portion of application can be obtained. There is a problem that, in a case where a small size of a fluid pressure cylinder (the diameter of a cylinder tube of which cylinder is small) is sufficient with regard movement from the period from the beginning of movement of the piston rod to just before the end portion, due to the great application force required at the end of piston movement, a fluid pressure cylinder which is big, heavy, and expensive must be used.

Because of this, conventionally, a fluid pressure cylinder is provided with a booster apparatus which is connected with a pipe line supplying fluid pressure to the fluid pressure cylinder for increasing application force just before the end of piston rod movement by applying higher pressure at the end position of movement of a piston rod.

However, this kind of a booster apparatus has a problem that, not only its structure is complicated but, also, it requires at least four solenoid operated valves, which leads to increased cost.

SUMMARY OF THE INVENTION

In accordance with the present invention, a pressure-intensifying type fluid pressure cylinder comprises a rod cover, an auxiliary cylinder chamber which is disposed outside the rod cover, a piston rod, a pressure intensifying piston which is axially slidably disposed at the outer peripheral portion of the piston rod in the auxiliary cylinder chamber, the outer peripheral portion of the piston rod having a different level portion for pressing the pressure intensifying piston and also having a lock concave portion, the rod cover having a fluid passage within itself which fluid passage lets fluid pressure come in the auxiliary cylinder chamber between the pressure intensifying piston and the rod cover when the different level portion presses the pressure intensifying piston and a lock member which is disposed in the pressure intensifying piston for making the pressure intensifying piston and the piston rod one body by being fixed in the lock concave portion on the outer peripheral portion of the piston rod when fluid pressure comes in the auxiliary cylinder chamber.

With a pressure-intensifying type fluid pressure cylinder of the above arrangement, fluid pressure is applied in a cylinder chamber between a head cover and a piston, and the piston and a piston rod are driven in the extruding direction. Here, when the piston rod reaches around the end of extrusion, its different level portion comes in an auxiliary cylinder chamber, touches a pressure intensifying piston, and presses the pressure intensifying piston. Then, fluid pressure comes from the fluid passage disposed in the rod cover to the auxiliary cylinder chamber between the pressure intensifying piston and the rod cover, which fluid pressure presses the pressure intensifying piston in the direction of the piston rod, and together with this, a lock member in the pressure intensifying piston is fixed in a lock concave portion of the outer peripheral portion of the piston rod, and the pressure intensifying piston and the piston rod are made to be one body.

As the piston rod advances toward its endmost position, the application force by the movement of the pressure intensifying piston, because of the fluid pressure is added to the application of the piston rod and the application force of the piston rod is increased around the end of piston rod movement.

Also, according to the present invention, another pressure-intensifying type fluid pressure cylinder comprises a rod cover, an auxiliary cylinder chamber which is disposed outside the rod cover, a piston rod, a pressure intensifying piston which is axially slidably disposed at the outer peripheral portion of the piston rod in the auxiliary cylinder chamber, the rod cover having a fluid passage within itself which fluid passage allows fluid under pressure to come into auxiliary cylinder chamber between the pressure intensifying piston and the rod cover before the piston rod reaches its most advanced end position and the pressure intensifying piston, having around the piston rod space a tapered surface and steel balls for locking the pressure intensifying piston with the piston rod when such fluid, under pressure, comes into the auxiliary cylinder chamber and the pressure intensifying piston moves.

With a pressure-intensifying type fluid pressure cylinder of the above arrangement, fluid pressure is applied in a cylinder chamber between a head cover and a piston. The piston and piston rod are driven in a forward direction. Here, just before the piston rod reaching its most forward position of movement, fluid pressure comes from the fluid passage disposed in the rod cover to an auxiliary cylinder chamber between a pressure intensifying piston and the rod cover, which fluid pressure presses the pressure intensifying piston in the direction of the piston rod and, together with piston pressing, steel balls for lock the pressure intensifying piston are pressed against the outer peripheral portion of the piston rod by the tapered surface in the space, and the pressure intensifying piston is locked to the piston rod. After this occurs and until the piston rod reaches its endmost position of movement, the application force by the movement of the pressure intensifying piston due to the fluid pressure is added to the application force of the piston rod and the application force of the piston rod is increased just before the end of movement.

The object of the present invention is, as described in the above, to provide a pressure-intensifying type fluid pressure cylinder with which increased application force can be provided just before and at the end of movement of a piston rod, the structure of which is comparatively simple, and miniaturizing of which is possible.

DESCRIPTION OF THE PREFERRED EMBODIMENTS

Preferred embodiments of the present invention are now described in the following according to the drawings.

Figure 1:
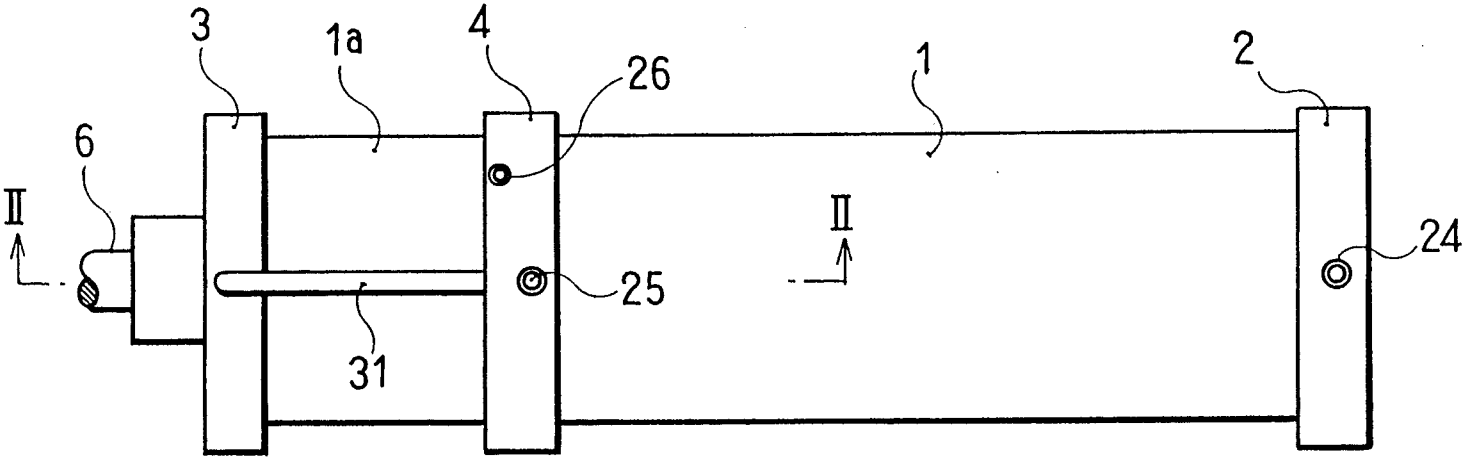
FIG. 1 is a plan view of a fluid pressure cylinder which shows an embodiment of the present invention.
Figure 2:
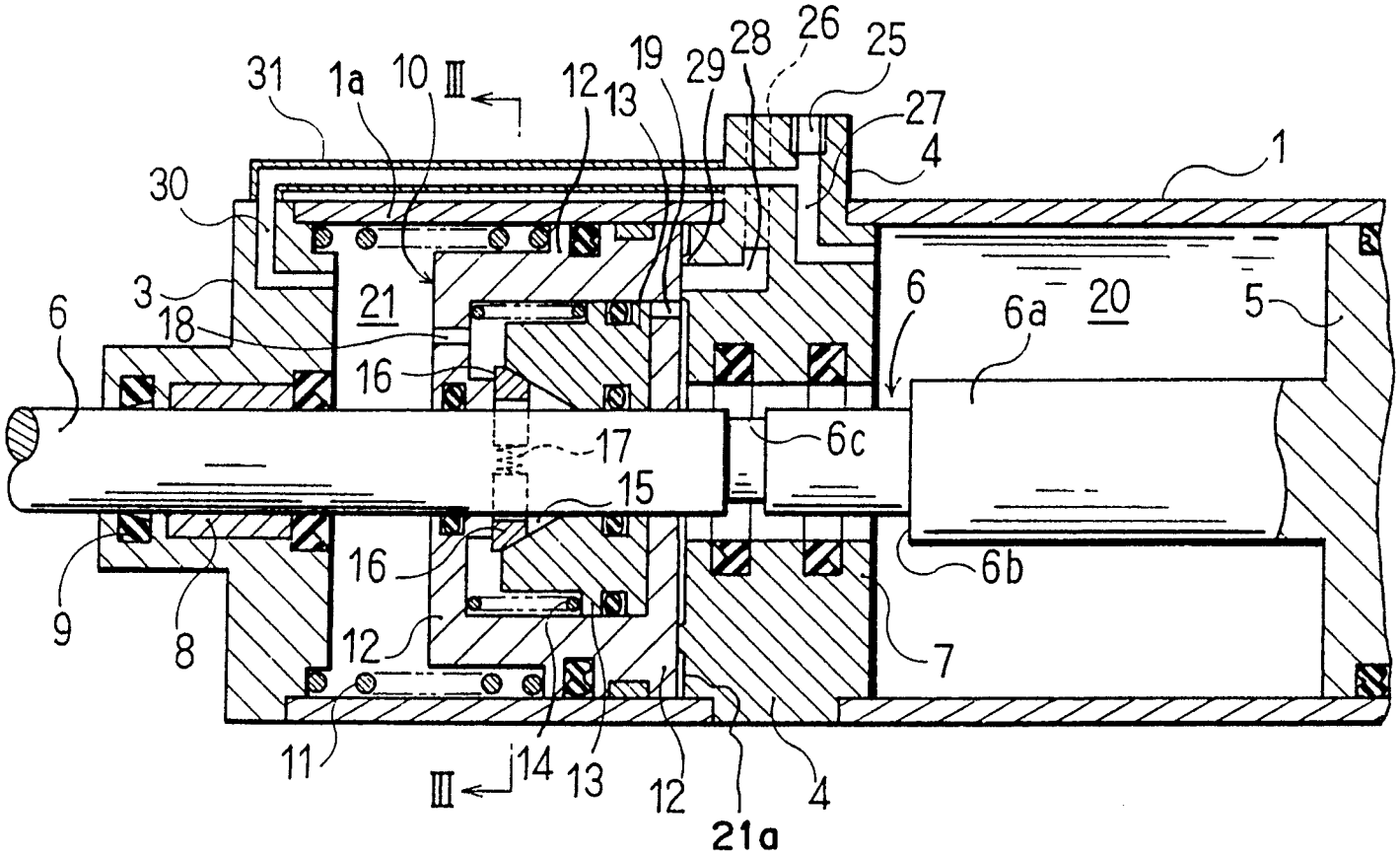
FIG. 2 is an enlarged sectional view taken along the line II—II of FIG. 1.

FIG. 1 is a plan view of a fluid pressure cylinder as a preferred embodiment of the present invention. FIG. 2 is a sectional view taken along the line II—II of FIG. 1. A head cover 2 is fixed at the rear end of a cylinder tube 1 so as to close the rear end of the cylinder tube 1. A rod cover 4 is fixed on the front end side of the cylinder tube i so as to slidably support a piston rod 6 and so as to close the open portion of the tube. Further, an auxiliary cylinder tube 1*a* is connected with and fixed to the outside of the rod cover 4. An auxiliary rod cover 3 is fixed to the front end of the auxiliary cylinder tube 1*a* so as to close the end portion and so as to slidably support the piston rod 6. An auxiliary cylinder chamber 21 is formed on the front end side of a cylinder chamber 20 in the auxiliary cylinder tube 1*a*.

A piston 5 is inserted and fixed in the cylinder tube 1. The piston rod 6 is fixed in the piston 5. As shown in FIG. 2, the piston rod 6 has a portion of larger radius 6*a* at its bottom portion. Following the portion of larger radius 6*a*, a rod of normal radius extends to the front end through a different level portion 6*b*. Further, a circular channel 6*c* as a lock concave portion is disposed at the outer peripheral portion of the piston rod 6. A lock member 16, described later herein, is fixed for engagement in the circular channel 6*c* prior to the end of movement of the piston rod 6.

A hole, through which piston rod 6 passes, is provided in the middle of rod cover 4. The diameter of the hole is larger than the diameter of piston rod 6 and large enough to receive the larger radius 6*a* which can slide tightly through such hole. A seal member 7 is fixedly attached on the inner peripheral side of rod cover 4 around the hole. Also, a metal bearing 8 and a seal member 9 are fixedly attached on a hole in the middle of the rod cover 3 which hole slidably supports the piston rod 6.

A pressure intensifying piston 10 is slidably mounted in the auxiliary cylinder chamber 21. A coil spring 11 is disposed between the pressure intensifying piston 10 and the rod cover 3. By the coil spring 11, the pressure intensifying piston 10 is urged to the right in FIG. 2, that is, toward rod cover 4.

Lock piston 13 is slidably mounted in pressure intensifying piston 10. The piston rod 6 passes through the middle of pressure intensifying piston 10 and lock piston 13. A coil spring 14 is disposed in housing 12 of pressure intensifying piston 10. Coil spring 14 urges lock piston 13 to the right in FIG. 2, that is, toward base portion 12.

Figure 3:
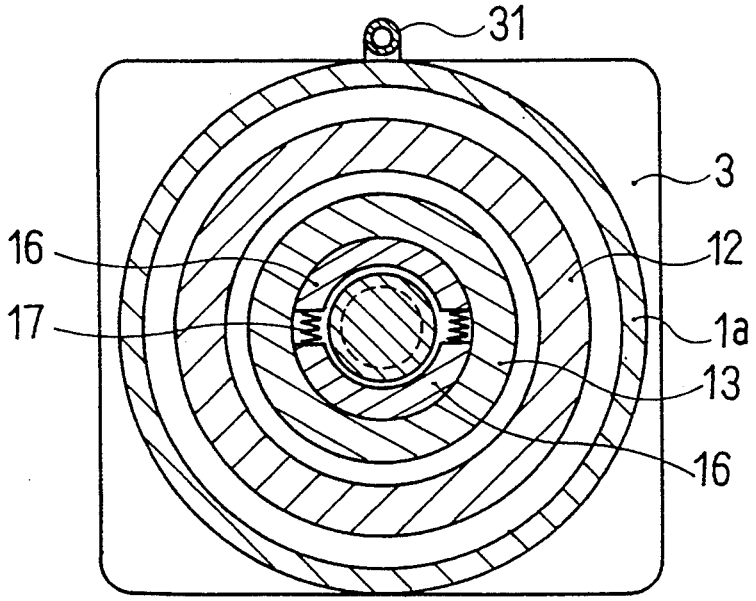
FIG. 3 is a sectional view taken along the line III—III of FIG. 2.

A conically concave portion 15, having a conically tapered surface, is formed on the inner peripheral portion on the front end of the lock piston 13. Lock members 16, which are in the shape of a ring divided into two sections, are disposed in the conically concave portion 15 so as to surround the outer peripheral portion of the piston rod 6 (see FIG. 3). Lock members 16 are urged in an outward direction by springs 17 disposed between the two pieces of the lock members 16. The outer peripheral surfaces of the lock members 16 touch the conically tapered surface of the conically concave portion. The front surfaces on the front end of the lock members 16 touch the wall portion at the front or forward end of the housing 12.

When the lock piston 13 is moved to the left in FIG. 2, the lock members 16 are moved inwardly toward piston rod 6, that is, in a direction decreasing the radius of the ring and compressing the spring 17 due to force applied by the conically tapered surface. Because, as described in the above, the circular channel 6*c*, in which the lock members can be received is disposed at a part of the piston rod 6, when the lock piston 13 and piston rod 6 move to the left in housing 12 and the circular channel 6*c* is positioned opposite to the lock members 16, the lock members 16 contact, engage and are fixed in the circular channel 6*c*, FIGS. 4 and 5.

Passages 18 and 19 are formed on opposite ends of the housing 12 of the pressure intensifying piston 10 and connect the inside of the housing 12 and the outside of auxiliary cylinder chamber 21. The passage 19 is disposed on the end of housing 12 adjacent the rod cover 4.

A supply and exhaust port 25 connects the rod cover 4 with the cylinder chamber 20 through a passage 27 and is disposed in the rod cover 4. Also, a supply and exhaust port 26 connects the rod cover 4 with the auxiliary cylinder chamber 21*a* through a passage 28 and is disposed in the rod cover 4. A valve seat 29 is formed at the open end portion on the side of the auxiliary cylinder chamber 21*a* of the passage 28. When the pressure intensifying piston 10 touches the rod cover 4, the side of the housing 12 closely adheres to the valve seat 29 and closes the open portion of the passage 28. In other words, a valve portion is formed by a part of the housing 12 and the valve seat 29.

A passage 30, which connects the auxiliary rod cover 3 with the auxiliary cylinder chamber 21 is formed in the auxiliary rod cover 3 of the front end portion. The passage 30 is connected with the passage 27 through a pipe line 31, which passage 27 itself is connected with the cylinder chamber 20. On the other hand, a supply and exhaust port 24 which connects the head cover 2, FIG. 1, with the bottom portion side of the cylinder chamber 20 is disposed in the head cover 2 of the bottom portion (see FIG. 1).

Seal members are fixedly attached to the outer peripheral portion of the housing 12 of the pressure intensifying piston 10 which touches the auxiliary cylinder tube 1*a*, the inner peripheral portion of the housing 12 which touches the piston rod 6, and the outer and inner peripheral portions of the lock piston 13.

Next, the operation of a fluid pressure cylinder of the above arrangement is described in the following.

The supply and exhaust ports 24 and 26 are connected with one port of a directional control valve which valve itself is connected with a fluid pressure source. The supply and exhaust ports 25 is connected with the other port of the directional control valve.

When the directional control valve is switched and fluid pressure is applied to the supply and exhaust ports 24 and 26, with the piston rod 6 in the retracting position or an intermediate position (FIG. 2), the piston 5 receives application force to the left in FIG. 2 and the piston rod 6 goes in the advancing movement direction toward the left in FIG. 2. Fluid pressure is also applied to the passage 28, through the supply and exhaust port 26, and the pressure intensifying piston 10 is pressed to the left in FIG. 2. However, as the coil spring 11 is stronger than the fluid pressure applied to the area of pressure intensifying piston 10, the pressure intensifying piston 10 does not move.

Figure 4:
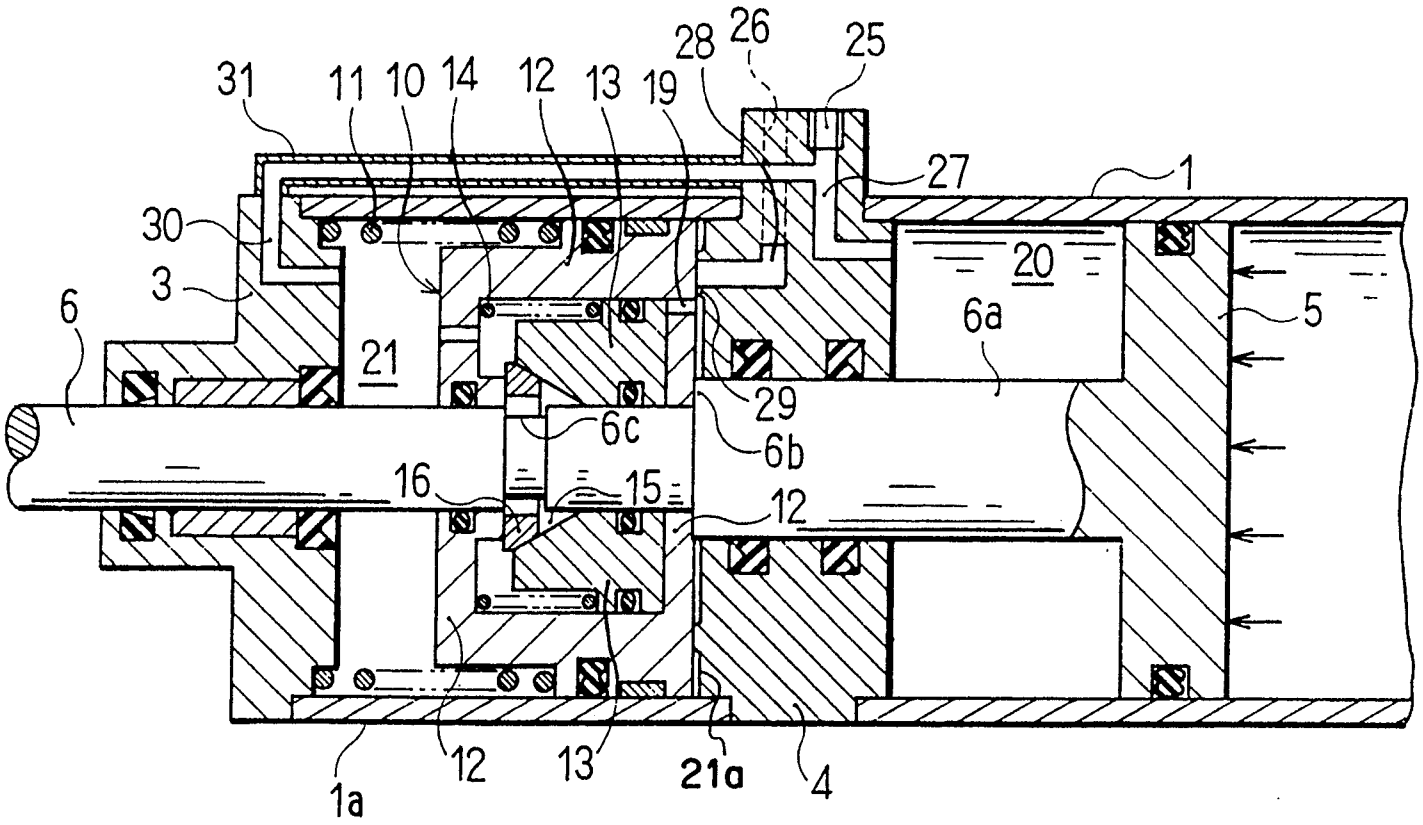
FIG. 4 is a sectional view showing a state when a different level portion of a piston rod touches a pressure intensifying piston.

When piston rod 6 reaches the position shown in FIG. 4, the different level portion 6*b* touches the rear surface (the right side in FIG. 4) of the housing 12 of the pressure intensifying piston 10 and the pressure intensifying piston 10 is pressed to the left and begins to move. The rear surface of housing 12, which closely adhered to the valve seat 29, leaves the valve seat 29, and fluid enters auxiliary cylinder chamber 21*a* at the right side, FIG. 4, of pressure intensifying piston 10, through the passage 28. Due to this fluid pressure, the pressure intensifying piston 10 is pressed to the left, FIG. 4, and at the same time, fluid comes in the housing 12 through the passage 19.

Fluid which comes in the housing 12 through the passage 19 presses the lock piston 13 to the left and the lock piston 13 moves to the left in FIG. 4. Due to this movement of the lock piston 13 to the left, the lock members 16 receive force from the tapered surface of the conically concave portion 15 in the direction of decreasing radius. The two pieces of lock members 16 move toward the center with the spring 17 compressed and become fixed in the circular channel 6*c* formed in the piston rod 6 (see FIG. 5).

Figure 5:
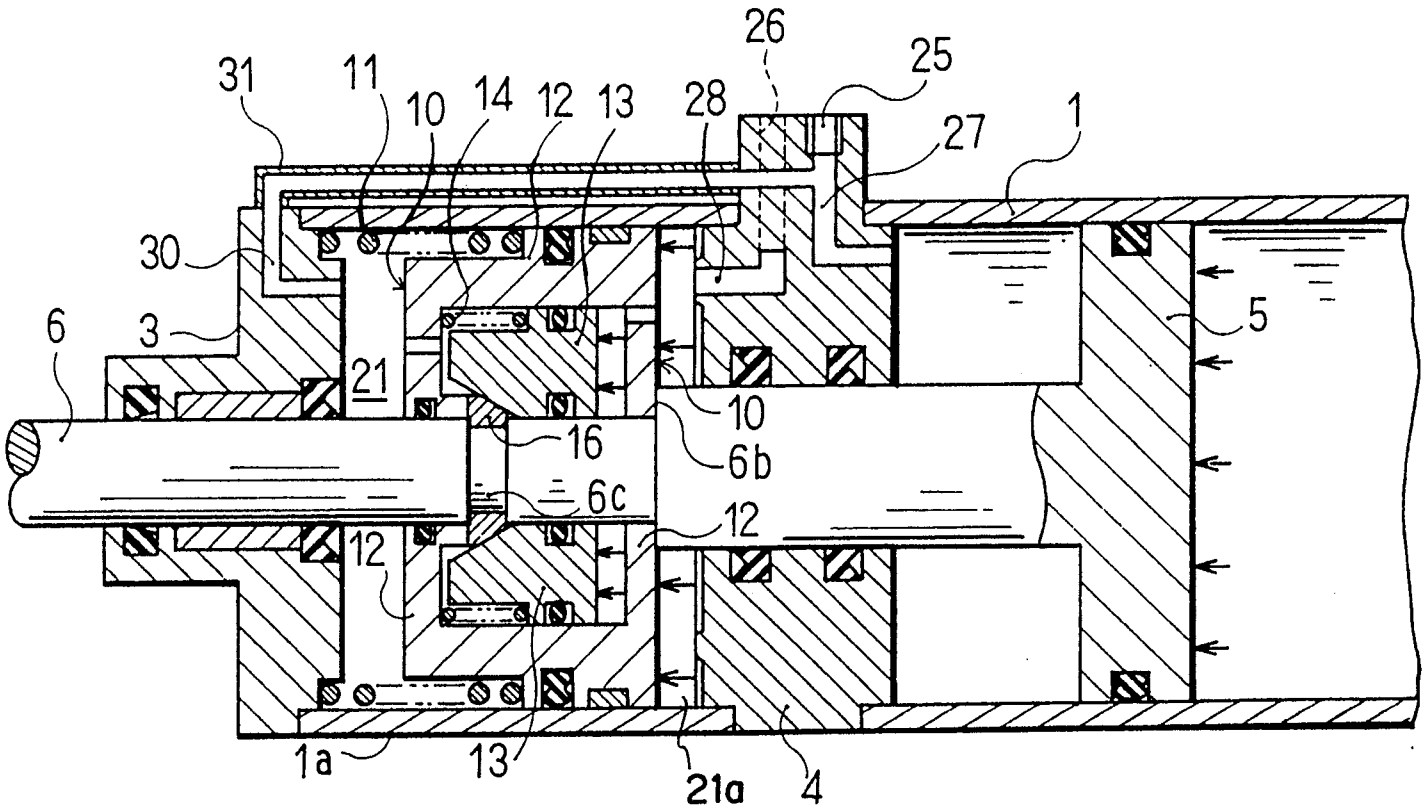
FIG. 5 shows a sectional view showing a state when a lock member is fixed in a circular channel.

By this fixing of the lock members 16 in the circular channel 6*c* of the piston rod 6, the pressure intensifying piston 10 and the piston rod 6 become one body, and as shown in FIG. 5, fluid pressure is applied to the rear surface of the pressure intensifying piston 10, the rear surface of the lock piston 13 and the rear surface of the piston 5. Thus, piston rod 6 is strongly pressed to the left, in FIG. 5, by the total of the pressure on piston 5, pressure intensifying piston 10, and lock piston 13.

Therefore, piston rod 6, reaching the position shown in FIG. 5, is driven toward the left by the application force to pressure intensifying piston 10 and lock piston 13, in addition to the force applied to the piston 5. In other words, toward the end of piston movement, the application force of the piston rod 6 is increased by the area of the pressure intensifying piston 10 and the lock piston 13, and with this state of intensified pressure, the piston rod 6 is forced to the end position.

When the piston rod 6 is operated to retract; the directional control valve is switched, fluid pressure is applied from the supply and exhaust port 25, and the supply and exhaust port 26 is connected with the exhaust side. Pressure applied in auxiliary cylinder chamber 21*a* to the rear side of the lock piston 13 is released, spring 14 moves lock piston 13 to the position shown in FIG. 4, and by the action of the spring 17, the two pieces of the lock members 16 are released and disengage the circular channel 6*c* of the piston rod 6.

When so released, the pressure intensifying piston 10 moves freely to the right in FIG. 5 due to force of the coil spring 11 and fluid pressure from port 25, pipe 31 and passage 30 into the auxiliary cylinder chamber 21. As shown in FIG. 4, the pressure intensifying piston 10 moves to the right until its rear surface touches and closes valve seat 29 on rod cover 4, and returns to the original state. Piston rod 6 is retracted to the end by force to the right which is received by the front surface of the piston 5 in cylinder chamber 20.

Figure 6:
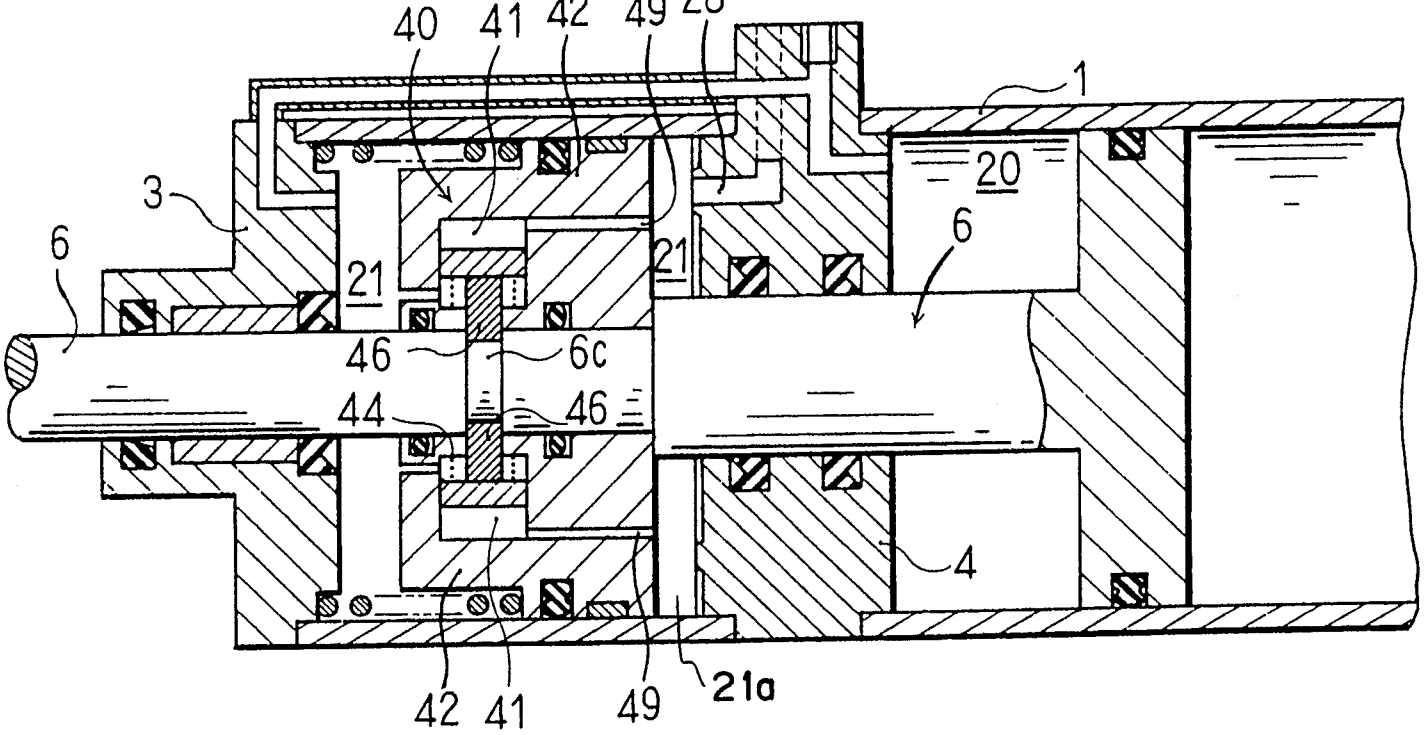
FIG. 6 is a sectional view of a fluid pressure cylinder as another embodiment of the present invention showing a state when lock pins are fixed in a circular channel.

FIG. 6 shows another embodiment of the present invention. In this embodiment, instead of the lock members 16 the shapes of which are in the shape of a ring divided in two, a plurality of lock pins 46 are used. In other words, in a pressure intensifying piston 40, a plurality of lock cylinder chambers 41 are provided perpendicularly to the axis of the piston rod. Lock pins 46 are inserted and fixed in the cylinder chambers 41 with the tips of the lock pins 46 being engageable in the circular channel 6*c* of the piston rod 6. The cylinder chambers for lock 41 are connected with the auxiliary cylinder chamber 21*a* through a passage 49. It is to be noted that the circular channel 6*c* may be holes into which the lock pins 46 can be fixed rather than a channel.

By providing the pressure intensifying piston 40 having a plurality of lock pins 46 in the auxiliary cylinder chamber 21, similarly to the above-mentioned embodiment, the lock pins 46 are fixed in the circular channel 6*c* of the piston rod 6 around the end of left hand movement of the piston rod 6, and the pressure intensifying piston 40 and the piston rod 6 become one body. Therefore, as shown in FIG. 6, around the end of left hand movement of the piston rod 6, fluid pressure is applied to the rear surface of the pressure intensifying piston 10 as well as to the rear surface of the piston 5, and the piston rod 6 is strongly pressed to the left by the total of the above pressure.

It is to be noted that application force can be increased further around the end of movement of the piston rod by making the radius of the auxiliary cylinder tube and the auxiliary cylinder chamber larger than the radius of the cylinder tube on the right, increasing the radius of the pressure intensifying piston, and then increasing its area presented to the pressure.

As described in the above, according to a pressure-intensifying type fluid pressure cylinder of the present invention, when a piston rod approaches the end of its forward movement, the different level portions in the auxiliary cylinder chamber are activated and pressure applied to the piston is intensified. Here, fluid pressure comes between the pressure intensifying piston and the rod cover in the auxiliary cylinder chamber from a passage in a rod cover, and the pressure intensified piston is pressed in the direction of the piston rod. At the same time, a lock member in the pressure intensifying piston is fixed in a lock concave portion of the outer peripheral portion of the piston rod, and the pressure intensifying piston and the piston rod become one body. By this arrangement, during the time from this until the piston rod is extended to the end position, application force of the movement of the pressure intensifying piston receiving fluid pressure is added to application force of the movement of the normal piston. Force applied to the piston rod toward the end of piston travel can be greatly increased compared with that with a conventional fluid pressure cylinder of the same radius. Further, as the structure is that an auxiliary cylinder chamber is provided at the front end portion of a cylinder tube and the pressure intensifying piston is provided in such auxiliary cylinder, the cylinder can be formed in a very small size, its structure is comparatively simple, and it can be manufactured at low cost.

Figure 7:
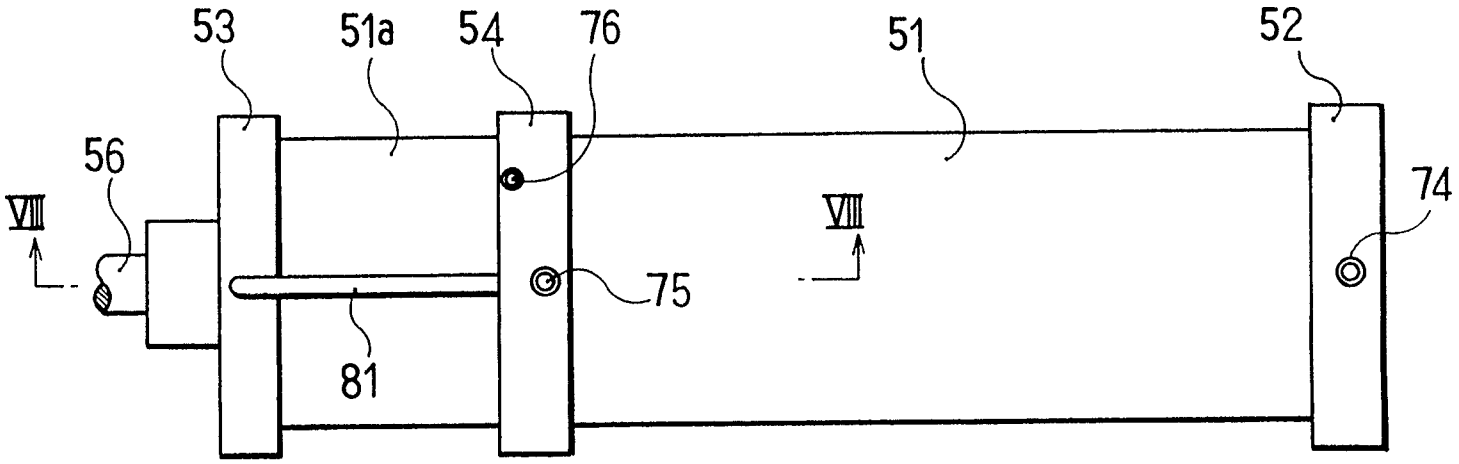
FIG. 7 is a plan view of a fluid pressure cylinder similar to FIG. 1 but showing a further embodiment of the present invention.
Figure 8:
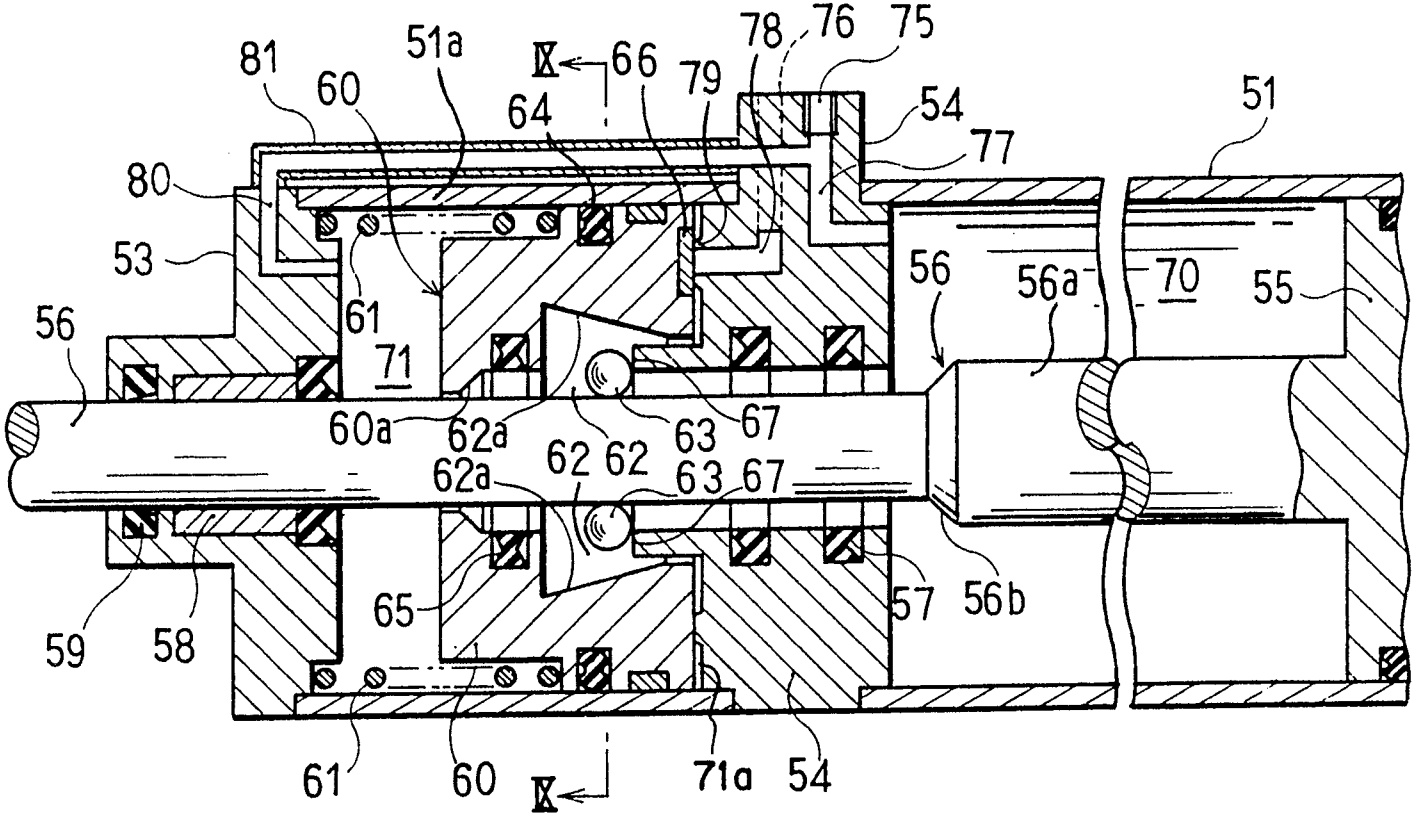
FIG. 8 is an enlarged sectional view of the embodiment of FIG. 7 taken along the line VIII—VIII of FIG. 7.
Figure 9:
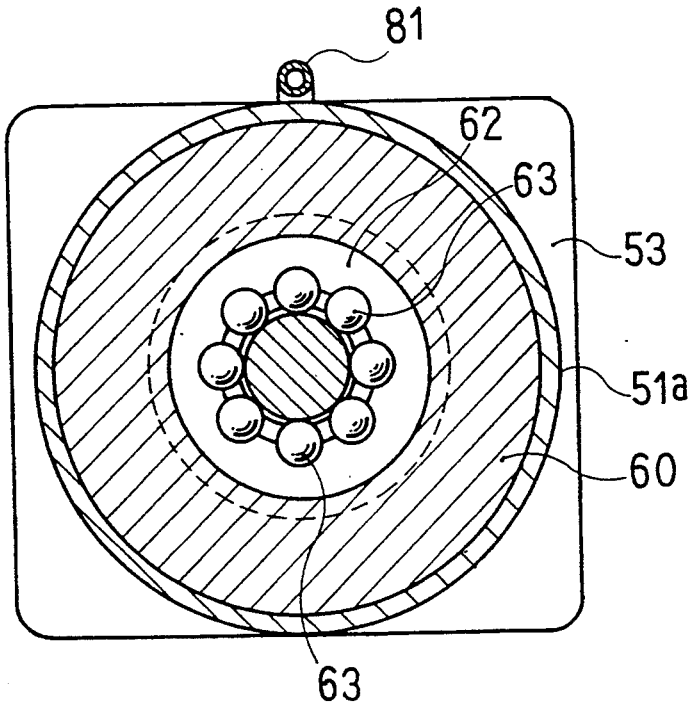
FIG. 9 is a sectional view taken along the line IX—IX of FIG. 8.

FIG. 7 is a plan view of a fluid pressure cylinder as a further embodiment. FIG. 8 is an enlarged sectional view taken along the line VIII—VIII of FIG. 7. A head cover 52, FIG. 7, is fixed at the rear end of a cylinder tube 51 so as to close the rear end of the cylinder tube 51. A rod cover 54 is fixed on the front end side of the cylinder tube 51 so as to slidably support a piston rod 56 and so as to close the open portion of the tube. Further, an auxiliary cylinder tube **51*a* is connected with and fixed to the outside of the rod cover 54. An auxiliary rod cover 53 is fixed to the front end of the auxiliary cylinder tube 51*a* so as to close the end portion and so as to slidably support the piston rod 56. An auxiliary cylinder chamber 71 is formed in the auxiliary cylinder tube 51*a***.

A piston 55 is inserted and slidably fixed in the cylinder tube 51. The piston rod 56 is fixed in the piston 55. As shown in FIG. 8, the piston rod 56 has a portion of larger radius **56*a* at its bottom portion. Following the portion of larger radius 56*a*, a rod of normal radius extends to the front end through a tapered different level portion 56*b***.

A hole through which the piston rod 56 goes is provided in the middle of the rod cover 54. The radius of the hole is exactly for the portion of larger radius **56*a* of the piston rod 56 and the portion of larger radius 56*a* can slide tightly through the hole. A seal member 57 is fixedly attached on the inner peripheral side of the hole. Also, a bearing metal 58 and a seal member 59 are fixedly attached on a hole in the middle of the auxiliary rod cover 53 which slidably supports the piston rod 56**.

A pressure intensifying piston 60 is slidably inserted and fixed in the auxiliary cylinder tube **51*a* between the rod cover 54 and the auxiliary rod cover 53, that is, in the auxiliary cylinder chamber 71. A coil spring 61 is disposed between the pressure intensifying piston 60 and the auxiliary rod cover 53. By the coil spring 61, the pressure intensifying piston 60 is energized to the right in FIG. 8**, that is, toward the base portion.

The piston rod 56 is inserted and fixed in a hole of the pressure intensifying piston 60 which hole is bored in the center of and in the direction of the axis of the pressure intensifying piston 60. A tapered portion **60*a*, tapered to match tapered portion 56*b* of the piston rod 56, is formed on pressure intensifying piston 60. Further, space 62, having a tapered surface 62*a*, is formed around piston rod 56 inside pressure intensifying piston 60. The space 62 is located so as to surround the piston rod 56, and its tapered surface 62*a* is formed so as to be tapered in the direction of the piston 55 end of the piston rod 56**.

In addition, steel balls 62, for example eight in number, are disposed in the space 62 so as to surround the piston rod 56. The steel balls 63 have a diameter so as to touch the tapered surface **62*a* and the peripheral outer surface 56*a* of the piston rod 56 when the portion of larger radius 56*a* comes in the space 62 of the pressure intensifying piston 60. A seal member 64 is fixedly attached to the outer peripheral portion of the pressure intensifying piston 60, and a seal member 65 is fixedly attached to the inner peripheral portion of the pressure intensifying piston 60**.

A lock release portion 67 is provided on rod cover 54 for releasing the lock by the steel balls 63 and protrude into the space 62 from rod cover 54. Lock release portion 67 releases locking steel balls 63 by pressing the steel balls 63 to the front end of tapered surface 62 when the piston rod 56 is retracted.

A supply and exhaust port 75 connecting the rod cover 54 with the cylinder chamber 70 through a passage is disposed in the rod cover 54. Also, a supply and exhaust port 76 which connects the rod cover 54 with the auxiliary cylinder chamber **71*a* through a passage 78 is disposed in the rod cover 54. A valve seat 79 is formed at the open end portion on the side of the auxiliary cylinder chamber 71*a* of the passage 78. A seal member 66 is fixedly attached to the side of the pressure intensifying piston which faces the valve seat 79. When the pressure intensifying piston 60 touches the rod cover 54, the seal member 66 closely adheres to the valve seat 79 and closes the open portion of the passage 78. In other words, a valve portion is formed by the seal member 66 and the valve seat 79**.

A passage 80 which connects the auxiliary rod cover 53 with the auxiliary cylinder chamber 71 is formed in the auxiliary rod cover 53 of the front end portion. The passage 80 is connected with the passage 77 through a conduit 81, which passage 77, itself, is connected with the cylinder chamber 70. On the other hand, a supply and exhaust port 74, connecting the head cover 52, FIG. 7, with the bottom portion side of the cylinder chamber 70, is disposed in the head cover 52 of the bottom portion (see FIG. 7).

Next, the operation of a fluid pressure cylinder of the above arrangement is described in the following.

The supply and exhaust ports 74 and 76 are connected with one port of a directional control valve which valve itself is connected with a fluid pressure source. The supply and exhaust port 75 is connected with the other port of the directional control valve.

When the directional control valve is switched and fluid pressure is applied to the supply and exhaust ports 74 and 76 with the piston rod 56 in the retracting position or an intermediate position (FIG. 8), the piston 55 receives application force from the right in FIG. 8 and the piston 55 and piston rod 56 are moved to the left.

Here, the fluid pressure is also applied to the passage 78 through the supply and exhaust port 76 and the pressure intensifying piston 60 is pressed to the left in FIG. 8. However, as the coil spring 61 is stronger than the applied fluid pressure, the pressure intensifying piston 60 does not move relative to rod cover 54. The piston rod 56 goes to the left in FIG. 8, and when its different level portion **56*b* passes into the space 62 in the pressure intensifying piston 60 through the rod cover 54, the piston rod 56 advances father to the left and tapered portion 56*b* on piston rod 56 engages and lifts each of the steel balls 63**.

Figure 10:
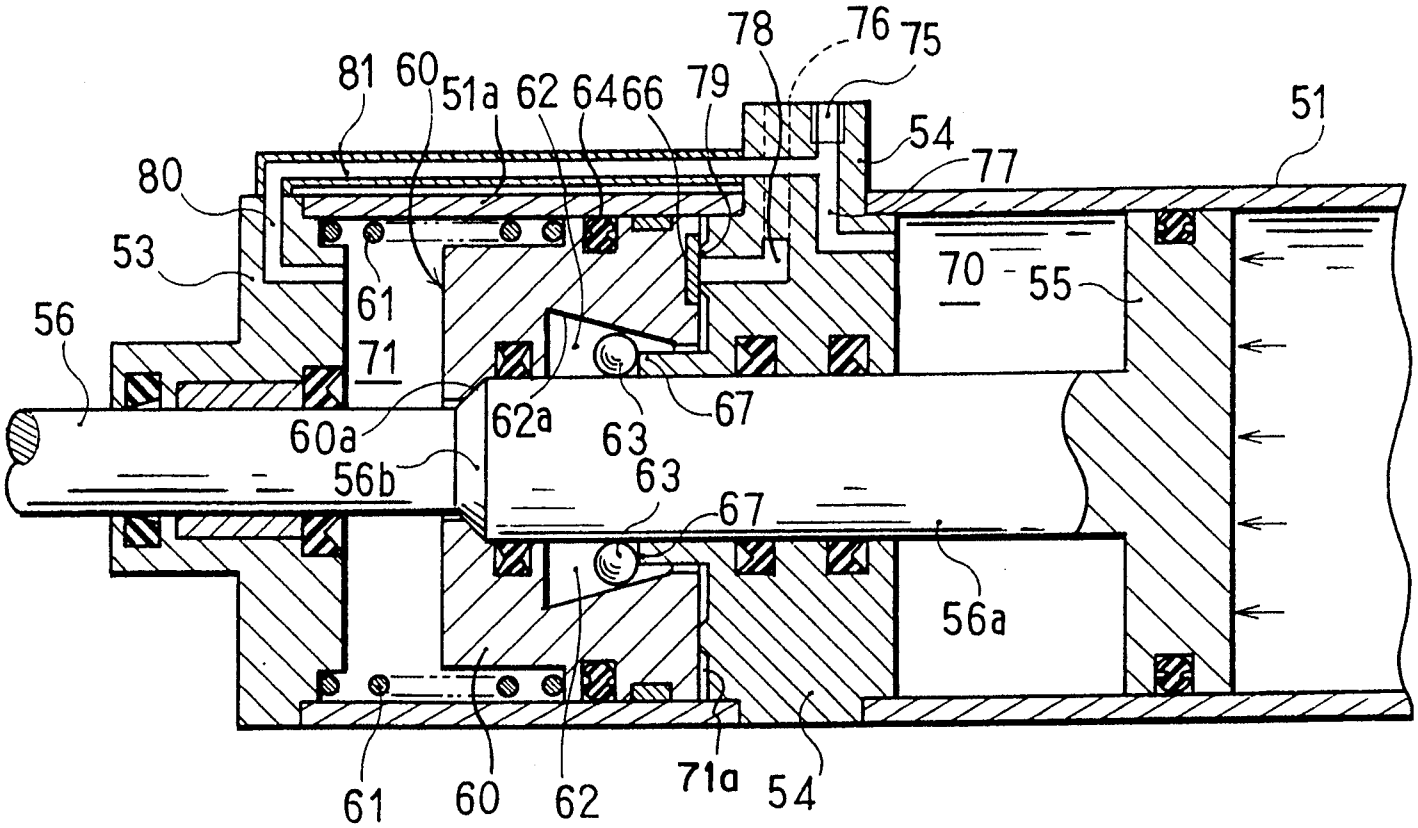
FIG. 10 is a sectional view of the embodiment of FIG. 7 showing a state when a different level portion of a piston rod touches a pressure intensifying piston.

When the piston rod 56 reaches the position shown in FIG. 10, the tapered portion **56*b* of piston rod 56 engages the portion 60*a* of the pressure intensifying piston 60. Thus, the pressure intensifying piston 60 is pressed to the left, the seal member 66 leaves the valve seat 79, and fluid under pressure enters auxiliary cylinder chamber 71*a*, at the right side end, FIG. 10, of pressure intensifying piston 60 through the passage 78. Due to this fluid pressure, the pressure intensifying piston 60 is pressed to the left, FIG. 10, and at the same time, fluid enters the space 62 in pressure intensifying piston 60**.

Because of the movement of the pressure intensifying piston 60 to the left, FIG. 10, in the direction of extension of the piston rod 56 by such fluid pressure, the steel balls 63 in the space 62 are pressed against the outer peripheral portion of the portion of larger radius **56*a* of the piston rod 56 by the tapered surface 62*a* of pressure intensifying piston 60 and lock pressure intensifying piston 60 to the piston rod 56**.

Figure 11:
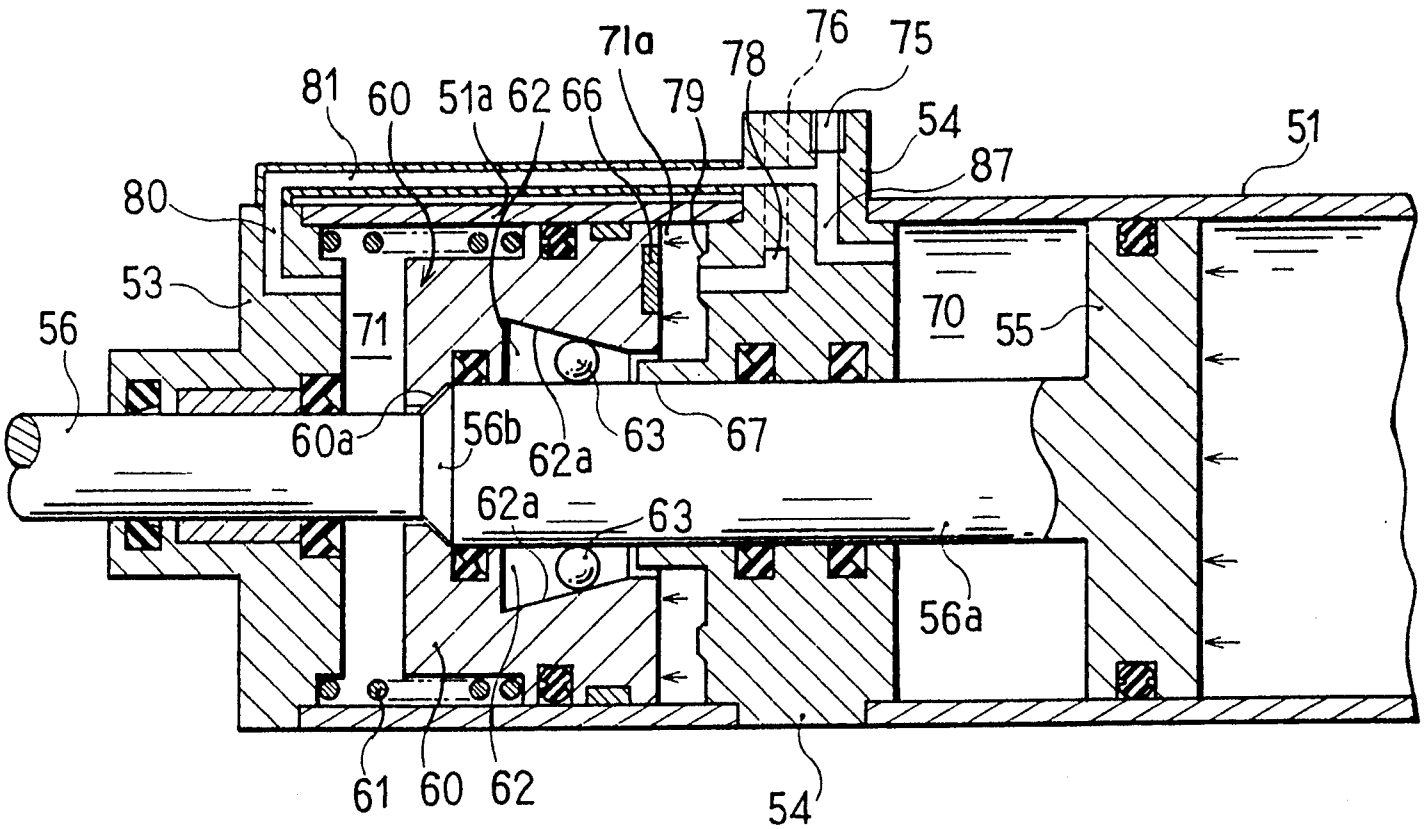
FIG. 11 is a sectional view of the embodiment of FIG. 7 showing a state when the pressure intensifying piston is locked with the piston rod through steel balls for lock.

Therefore, the piston rod 56, reaching the position shown in FIG. 11, is driven further by the application force of pressure intensifying piston 60 in addition to the application force of the piston 55. In other words, just before the end of piston movement, the application force of the piston rod 56 is increased by the area of the pressure intensifying piston 60 to which fluid pressure is applied, and with intensified pressure, the piston rod 56 is forced to the end portion.

On the other hand, when the piston rod 56 is operated to retract, the directional control valve is switched, fluid pressure is applied from the supply and exhaust port 75, and the supply and exhaust port 76 is connected with the exhaust side. Thus, the pressure applied to the rear side of the pressure intensifying piston 60, in auxiliary chamber **71*a*, is released, and the pressure intensifying piston 60 is moved back to the right in FIG. 11, together with the piston rod 56. When the pressure intensifying piston 60 moves back to the position which is shown in FIG. 10, that is, to the position where its rear surface touches the valve seat 79 of the rod cover 54, the steel balls for lock 63 are moved to the left in FIG. 10 by the lock release portion 67 and the lock of the pressure intensifying piston 60 with piston rod 56** is released.

Thus, the piston rod 56 is retracted to the end by force to the right received by the front surface of the piston 55 in cylinder chamber 70.

It is to be noted that application force can be increased further around the end of extending movement of the piston rod by making the radius of the auxiliary cylinder tube **51*a* of the auxiliary cylinder chamber larger than the radius of the cylinder tube 51**, increasing the radius of the pressure intensifying piston, and increasing the area presented to fluid pressure.

Figure 12:
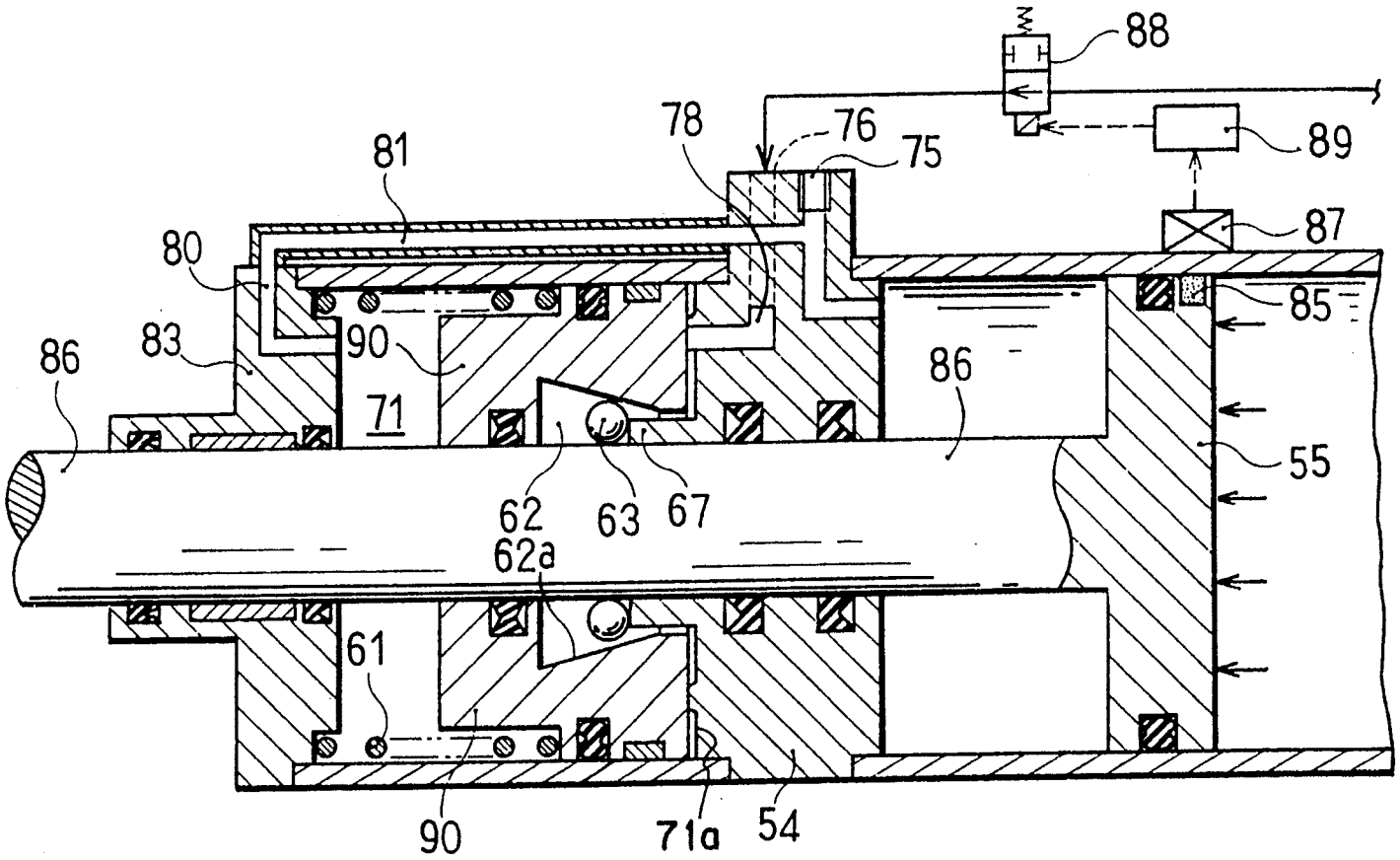
FIG. 12 is an enlarged sectional view of a fluid pressure cylinder showing a still further embodiment of the present invention.
Figure 13:
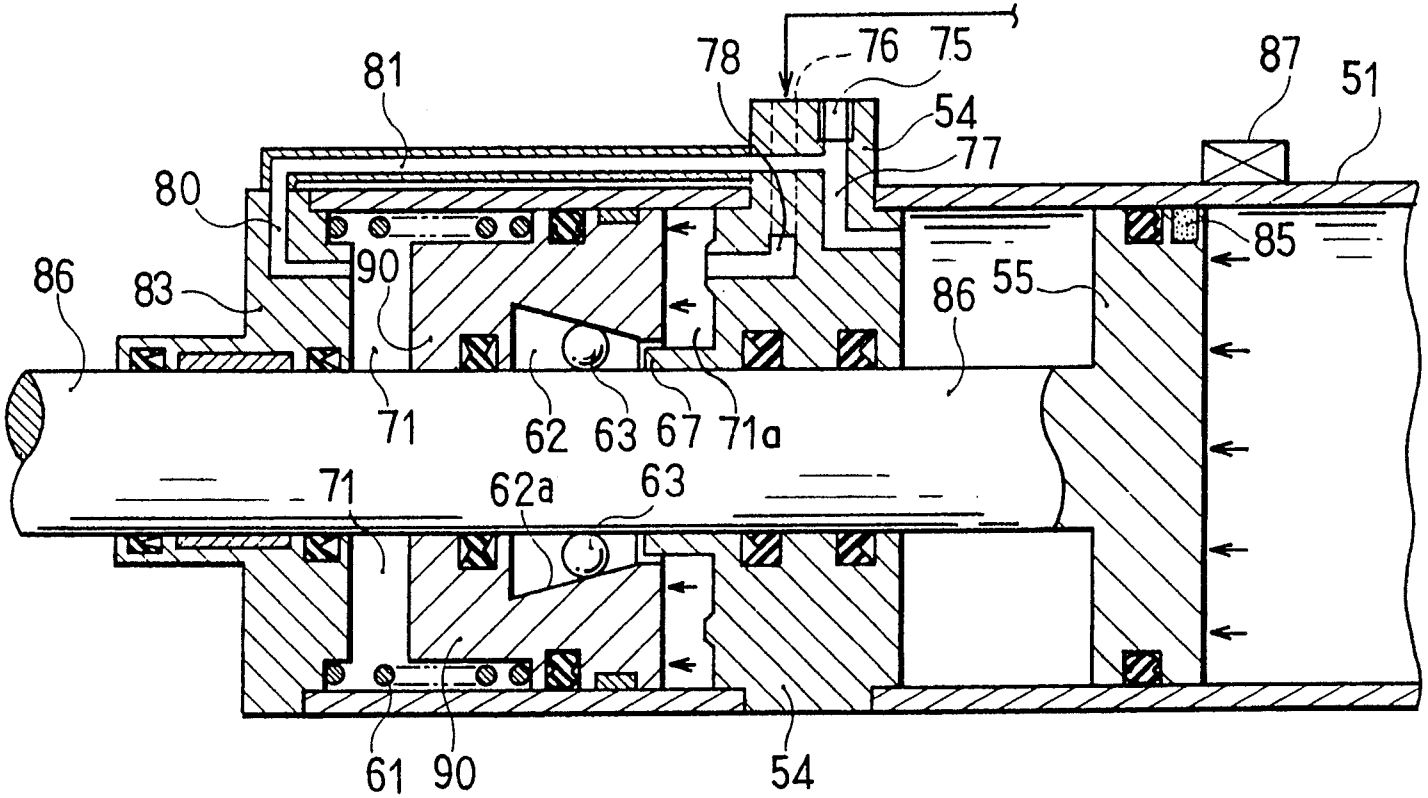
FIG. 13 is an enlarged sectional view near the end of movement of the fluid pressure cylinder.

FIGS. 12 and 13 show a still further embodiment of the present invention. In a pressure-intensifying type fluid pressure cylinder of this embodiment, a piston rod 86 is formed by a rod of the same radius, with no different level portion, and a pressure intensifying piston 90 having no touch portion is fixedly attached to the outer peripheral portion of the piston rod 86. There is no valve portion between the rod cover 54 and the pressure intensifying piston 90. The end of the passage 78 is opened to the inside of the auxiliary cylinder chamber **71*a* between the pressure intensifying piston 90 and the rod cover 54**.

Further, a magnet 85 is fixed on the outer peripheral portion of the piston 55. A proximity switch 87 as a detecting means for detecting the piston 55, which is reached a little before the end of movement of piston 55 and piston rod 86 is attached on the outer peripheral portion of the cylinder tube 51.

A control valve 88 is connected with a fluid pressure pipe line which pipe line, itself, is connected with the supply and exhaust port 76 connected with the passage 78 (connected with the fluid pressure source together with the supply and exhaust port 74), and the valve 88 is controlled to be opened by a control circuit 89 when the proximity switch 87 detects the piston just before the end of piston movement. Other members are arranged in the same manner as in the above embodiment.

In a pressure-intensifying type fluid pressure cylinder of the above arrangement, when the directional control valve is switched and fluid pressure is applied to the supply and exhaust port 74 with the piston rod 86 in the retracting position or an intermediate position, the piston rod 55 receives application force to the left in the figure and the piston rod 86 goes in the extruding direction.

When the piston rod 86 reaches the position which is shown in FIG. 12, that is, just before the end of piston movement, the proximity switch 87 detects the magnet 85 of the piston 55. The control circuit 89, to which this detecting signal is inputted, controls the valve 88 and opens valve 88. Then, fluid pressure is applied to the passage 78 and fluid pressure comes in the auxiliary cylinder chamber **71*a* between the rod cover 54 and the pressure intensifying piston 90. So, the pressure intensifying piston 90 is pressed to the left in the figure by the fluid pressure, and at the same time, fluid pressure also comes in the space 62**.

Due to the movement of the pressure intensifying piston 90 to the left in FIG. 12 by fluid pressure, the locking steel balls 63 in the space 62 are pressed against the outer peripheral portion of the piston rod 86 by the tapered surface **62*a* of piston 90. Thus, the pressure intensifying piston 90 is locked by the steel balls 63 to the piston rod 86**.

Therefore, the piston rod 86, which reaches the position shown in FIG. 13, is driven by the application force of pressure intensifying piston 90 in addition to the application force of the piston 55, and just before the end of piston movement, the application force of the piston rod 86 is increased by fluid pressure applied to the area of the pressure intensifying piston 90, and with this state of intensified pressure, the piston rod 86 is advanced to the end portion.

As described in the above, according to a pressure-intensifying type fluid pressure cylinder of the present invention, just before the piston rod reaches the end of extension movement, fluid pressure is applied to the pressure intensifying piston and the rod cover in the auxiliary cylinder chamber from a passage in a rod cover, the pressure intensifying piston is pressed in the direction of extension movement of the piston rod, and at the same time, steel balls lock in a space in the pressure intensifying piston and lock the pressure intensifying piston with the piston rod. By this arrangement, during the time just before the end of piston rod movement until the piston rod reaches the end of its movement, application force applied to the pressure intensifying piston is added to the force applied to the movement of the piston, and application force of the piston rod just before the end of movement can be greatly increased compared with that with a conventional fluid pressure cylinder of the same radius. Further, as the structure is that an auxiliary cylinder chamber is provided at the front end portion of a cylinder tube and the pressure intensifying piston is provided in such auxiliary chamber, the cylinder can be formed in a very small size, its structure is comparatively simple, and it can be manufactured at low cost.

What is claimed is:

1. A pressure-intensifying type fluid pressure cylinder comprising:

a cylinder tube;

a rod cover fixed at one of it ends to an end portion of said cylinder tube, an auxiliary cylinder tube fixed to the other end of said rod cover and having an auxiliary cylinder chamber therein, said rod cover having a fluid passage for feeding fluid under pressure into said auxiliary cylinder chamber;

a piston in said cylinder tube having a piston rod fixed at one end of said piston rod to said piston and extending through said rod cover, said pressure intensifying piston being slidable disposed on the outer periphery of said piston rod in said auxiliary cylinder tube; and locking means disposed in said pressure intensifying piston for locking said pressure intensifying piston to said piston rod in said auxiliary cylinder chamber for intensifying fluid pressure applied to said piston rod when said pressure intensifying piston is locked to said piston rod and fluid pressure is applied to said pressure intensifying piston in said auxiliary cylinder chamber.

2. A pressure-intensifying type fluid pressure cylinder, as recited in claim 1, wherein said locking means for locking said pressure intensifying piston to said piston rod includes a circular channel on an outer periphery of said piston rod, a lock piston having a conically concave portion and slidable in said pressure intensifying piston and a ring-shaped member disposed in said conically concave portion of said lock piston for engagement in said circular channel on said peripheral portion of said piston rod for locking said lock piston and said pressure intensifying piston to said piston rod when said ring-shaped member is engaged in said circular channel on said piston rod.

3. A pressure-intensifying type fluid pressure cylinder as recited in claim 1, wherein said pressure intensifying piston includes a valve seat for closing said fluid passage in said rod cover when said pressure intensifying piston engages said rod cover and for opening said fluid passage when said pressure intensifying piston and said rod cover are disengaged.

4. A pressure-intensifying type fluid pressure cylinder as recited in claim 1, wherein said locking means disposed in said pressure intensifying piston includes a plurality of cylinder chambers, each chamber having a locking pin perpendicular to said piston rod for engagement of said locking pin with a circular channel on an outer periphery of said piston rod when fluid pressure is applied to said cylinder chambers for locking said pressure intensifying piston to said piston rod.

5. A pressure-intensifying type fluid pressure cylinder comprising:

a cylinder tube;

a rod cover fixed at one end to one end of said cylinder tube, an auxiliary cylinder tube fixed to the other end of said rod cover;

a piston in said cylinder tube;

a piston rod connected at one of its ends to said piston in said cylinder tube and extending through said rod cover and an auxiliary cylinder chamber in said auxiliary cylinder tube;

a pressure intensifying piston axially slidably disposed on said piston rod in said auxiliary cylinder chamber, an inside of said pressure intensifying piston, around said piston rod, having a space with a tapered surface between said pressure intensifying piston and said piston rod; and steel balls disposed in said space in said pressure intensifying piston around said piston rod, said tapered surface in said pressure intensifying piston engaging said steel balls for locking said pressure intensifying piston to said piston rod and intensifying the force being applied to said piston rod by said piston when fluid pressure enters said auxiliary cylinder chamber and said pressure intensifying piston is moved relative to said piston rod.

6. A pressure-intensifying type fluid pressure cylinder as recited in claim 5, wherein said fluid pressure is applied in said auxiliary cylinder chamber by opening a valve on a fluid pressure passage on said rod cover, moving said pressure intensifying piston axially relative to said piston rod, locking said steel ball between said tapered surfaces on said piston rod and in said pressure intensifying piston and intensifying the fluid force being applied to said piston rod by said piston.

7. A pressure-intensifying type fluid pressure cylinder, as recited in claim 5, wherein said piston includes detecting means for detecting when said piston reaches a pre-set point before the end of travel in a pressure applying direction where pressure intensification in said auxiliary cylinder chamber is to be applied to said piston rod, a fluid pressure pipe line connected to a passage in said rod cover for passage of fluid pressure from said pipe line to said auxiliary cylinder chamber and a control valve connected to said detecting means for opening said control valve and applying fluid pressure to said pressure intensifying piston in said auxiliary cylinder chamber when said piston rod and said piston reach said point where said pressure intensification is to be applied and applying pressure-intensifying fluid pressure to said piston rod.

8. A pressure-intensifying type fluid pressure cylinder as recited in claim 5, wherein a lock release portion protrudes from said rod cover into said auxiliary cylinder chamber for contacting said steel balls and releasing said locking of said steel balls with said pressure intensifying piston and said piston rod and releasing said piston rod and said piston for retraction.

9. A pressure-intensifying type fluid pressure cylinder of claim 6, wherein said lock release portion protruding from said rod cover into said auxiliary cylinder chamber presses said steel balls into said space having said tapered surface to release said piston rod for retraction from said pressure intensifying piston.

10. A pressure-intensifying fluid type cylinder as recited in claim 7, wherein a lock release portion is protrudingly provided on said rod cover toward said auxiliary cylinder chamber for pressing said steel balls and releasing said piston rod for retraction from said pressure intensifying piston.

* * * * *